US005494612A

United States Patent [19]

Finucane

[11] Patent Number: 5,494,612

[45] Date of Patent: Feb. 27, 1996

[54] PROCESS FOR PRODUCING DETERGENT BAR WITH LOW SOAP COMPOSITION HAVING OPTIMAL THROUGHPUT AT LOWER TEMPERATURES

[75] Inventor: Kevin M. Finucane, Saddle Brook, N.J.

[73] Assignee: Lever Brothers Company, Division of Conopco, Inc., New York, N.Y.

[21] Appl. No.: 296,768

[22] Filed: Aug. 26, 1994

Related U.S. Application Data

[63] Continuation-in-part of Ser. No. 5,716, Jan. 19, 1993, abandoned.

[51] Int. Cl.[6] ..... C11D 1/94; C11D 1/28; C11D 13/18; C11D 1/02

[52] U.S. Cl. ..... 252/549; 252/554; 252/557; 252/545; 252/108; 252/117; 252/121; 252/541; 252/174.21; 252/174.22; 252/134; 252/546; 252/547; 252/550; 252/174; 252/174.11; 252/DIG. 5; 252/DIG. 7; 252/DIG. 16

[58] Field of Search ..... 252/DIG. 16, 108, 252/117, 121, 541, 174.21, 174.22, DIG. 5, DIG. 7, 134, 546, 547, 550, 554, 557, 545, 549, 174, 174.11

[56] References Cited

U.S. PATENT DOCUMENTS

| | | | |
|---|---|---|---|
| 3,723,325 | 3/1973 | Parran, Jr. | 252/547 X |
| 4,663,070 | 5/1987 | Dobrovolny et al. | 252/DIG. 16 |
| 4,673,525 | 6/1987 | Small et al. | 252/DIG. 16 |
| 4,954,282 | 9/1990 | Rys et al. | 252/DIG. 16 |
| 5,154,849 | 10/1992 | Visscher et al. | 252/DIG. 16 |
| 5,211,870 | 5/1993 | Gilbert et al. | 252/DIG. 16 |
| 5,232,633 | 8/1993 | Ilardi et al. | 252/549 X |
| 5,372,751 | 12/1994 | Rys-Cicciari et al. | 252/DIG. 16 |
| 5,393,449 | 2/1995 | Jordan et al. | 252/DIG. 16 |
| 5,433,894 | 7/1995 | Massaro et al. | 252/DIG. 16 |

*Primary Examiner*—Douglas J. McGinty
*Attorney, Agent, or Firm*—Ronald A. Koatz

[57] ABSTRACT

The present invention relates to detergent bar compositions comprising a specific ternary system. Specifically the composition comprises (1) about 10% to 70% of a first synthetic anionic surfactant and (2) 1 to 20% of a mixture of surfactants comprising a second anionic different from the first and an amphoteric surfactant, wherein the composition comprises less than 5% soap. In such compositions, the throughput rate of a bar made from processing the compositions through a plodder is higher at a temperature below 100° F. than it is above 100° F., said temperature referring to the temperature reading at just after said bar is extruded through said plodder.

6 Claims, 6 Drawing Sheets

PROCESS FOR PRODUCING DETERGENT BAR WITH LOW SOAP COMPOSITION HAVING OPTIMAL THROUGHPUT AT LOWER TEMPERATURES

CROSS REFERENCES

The present application is a continuation-in-part of U.S. Ser. No. 08/005,716, filed Jan. 19, 1993, abandoned.

BACKGROUND OF THE INVENTION

1. Field of the Invention

The present invention relates to detergent bars having relatively low soap contents and having a throughput rate at a temperature below 100° F. (as measured coming out of a plodder for extruding said soap bars) which is higher than a throughput rate at a temperature above 100° F.

2. Background

The rate at which a bar can be plodded through a plodder extrusion device is a function of the detergent tackiness value of the bar composition. Thus, if the tackiness value is too high, the bar will be too soft and sticky and will clog the machinery used to make the bar, thereby having an obviously adverse impact on throughput if the bar can be processed at all. While lowering the temperature of the bar coming out of the soap plodder (e.g., to below 100° F.) will decrease tackiness values, such bars will be too hard to effectively process at commercially viable throughput rates. That is, if the bars are so hard that fewer bars can be extruded, the process becomes economically unviable.

The temperature at which a detergent composition may be maintained when coming out of the plodder (i.e., how tacky the composition will be at a given temperature) is in turn, at least in part, a function of the component ingredients making up the composition.

Thus, for example, a pure soap composition (a composition in which the detergent active is, for example, at least 90% fatty acid soap) can be processed such that the temperature of the bar coming out of the plodder is below 100° F. and yet tackiness values remain low. In this regard, a pure soap composition can be processed while maintaining respectable throughput. However, such compositions have a high tolerance to heat (i.e., melting and tackiness do not become a problem until temperatures well over 100° F. are reached) and throughput rates are also much higher at these higher temperatures.

As so-called milder ingredients (e.g., anionic, nonionic or amphoteric coactives) are used to substitute for soap, the balance between tackiness (i.e., not so tacky that processing becomes impossible) and hardness (i.e., not so hard that throughput is suddenly lowered) is affected by temperatures coming out of the plodder. Thus, for example, for a commercially well-known Dove® bar whose major ingredient is cocoyl isethionate, optimal throughput rates are lower at temperatures of 100° F. coming out of a plodder relative to the throughput rates for pure soap compositions (e.g., Lux® soap), but the rates are still higher than the throughput rate at under 100° F. That is, although throughput rates is lower relative to pure soap compositions, tackiness values are not so high that optimal rates cannot still be obtained at temperatures above 100° F.

Since non-soap actives are generally less heat tolerant (i.e, will melt and cause tackiness problems more readily), it might have been believed that at some point compositions will be formulated such that, at temperatures above 100° F., tackiness becomes so high that throughput levels will drop below the throughput levels achievable when the temperature coming out of the plodder is below 100° F.

Nonetheless, thus far it has not been possible to produce and process a bar in which other actives are in excess to soap, i.e., in which soap preferably comprises less than 5% and more preferably less than 3% of the composition and in which the throughput rates, when the bar is processed at temperatures below 100° F. coming out of the plodder, are higher than throughput rates when the bar is processed at temperatures above 100° F. coming out of the plodder. Specifically, it has not been possible to make bars at an economically viable rate, i.e., a rate at which tackiness values are sufficiently tolerable that the throughput rate is high enough to make the process viable.

By economically sufficient viable is meant a throughput rate of at least 300 pounds/hour (lbs/hr) when measured coming out of a Mazzoni M-150 refiner/plodder or a throughput rate of greater than 2500 lbs/hr coming out of a commercial packing line (using, for example, a Mazzoni B-300/3500 plodder).

U.S. Pat. No. 5,154,849 to Visscher et al. discloses mild skin cleaning toilet bars comprising 0.5 to 20% of a silicone component and up to 90% of a cleaning component which may be 0 to 90% soap and 0 to 90% of a mixture of surfactants. This mixture may include acyl isethionate, sulfosuccinates and betaines.

Visscher et al. does not, however, recognize the criticality of using a specific ternary surfactant system. Further, Visscher et al. prefers levels of 5 to 40% soap and there is no recognition that levels under 5% soap must be maintained. Visscher, in fact, suggests the use of higher levels of soap.

U.S. Pat. No. 4,673,525 to Small et al. discloses cleaning compositions comprising 20 to 70% mild synthetic surfactant and 5.5 to 25% soap. Again, there is no recognition of a specific ternary system. Further, the amounts of soap used are above those required by the subject invention.

Finally, U.S. Pat. No. 4,954,282 to Rys et al. discloses acyl isethionate skin cleansing compositions containing coactive surfactants including sulfosuccinates and betaines. The isethionate used in the Rys et al. application, however, requires that the isethionate mixture be such that $C_{16}$ to $C_{18}$ chain lengths form greater than 75% of the mixture. This "stearic" DEFI, as it is known, is specifically disclaimed from the subject invention because it has poor lather properties and is much more difficult to process.

Unexpectedly, applicants have now discovered a composition comprising a first synthetic surfactant, which is an anionic surfactant; a mixture of surfactants wherein said mixture comprises, a second anionic surfactant which is different from the first and amphoteric surfactant; and low values of soap, i.e., preferably below 5% and more preferably below 3% and which composition has a higher throughput rate when processed at a temperature of below 100° F. coming out of a soap plodder/extruder relative to the throughput rate at temperatures above 100° F. Moreover tackiness values are sufficiently low, i.e., below 4, preferably from 2 to 4, to ensure a throughput rate which is commercially viable.

If either anionic surfactant is a $C_6$ to $C_8$ acyl isethionate, the percentage of $C_{16}$ to $C_{18}$ chain length isethionate is less than 75% of the isethionate mixture, preferably less than 70%, more preferably less than 60% and most preferably less than about of the isethionate mixture.

BRIEF SUMMARY OF THE INVENTION

The present invention relates to detergent bar compositions comprising:

(1) a first synthetic sudactant which is an anionic surfactant;

(2) a mixture of surfactants wherein said mixture comprises a second anionic surfactant which is different from the first and amphoteric surfactant;

wherein the composition has less than 5% by wt. soap, more preferably less than 3% by wt. soap;

wherein the composition has a higher throughput rate when processed at a temperature of under 100° F. when coming out of a plodder than when processed at temperatures above 100° F. Moreover, tackiness values are maintained sufficiently low, i.e., below 5, preferably from 1 to 4 such that the composition can be processed at commercially viable throughput rates, i.e., at a rate greater than 2500 pounds per hour when coming out of a commercial packing line. As noted, preferably the composition has a soap content of less than 5% and more preferably less than 3%.

Further, if either anionic surfactant is a $C_6$ to $C_{18}$ acyl isethionate mixture, the percentage of $C_{16}$ to $C_{18}$ chain length isethionate is less than 75%, preferably less than 70%, more preferably less than 60% and most preferably, less than about 50% of the acyl isethionate mixture.

DETAILED DESCRIPTION OF THE INVENTION

Figure 1:
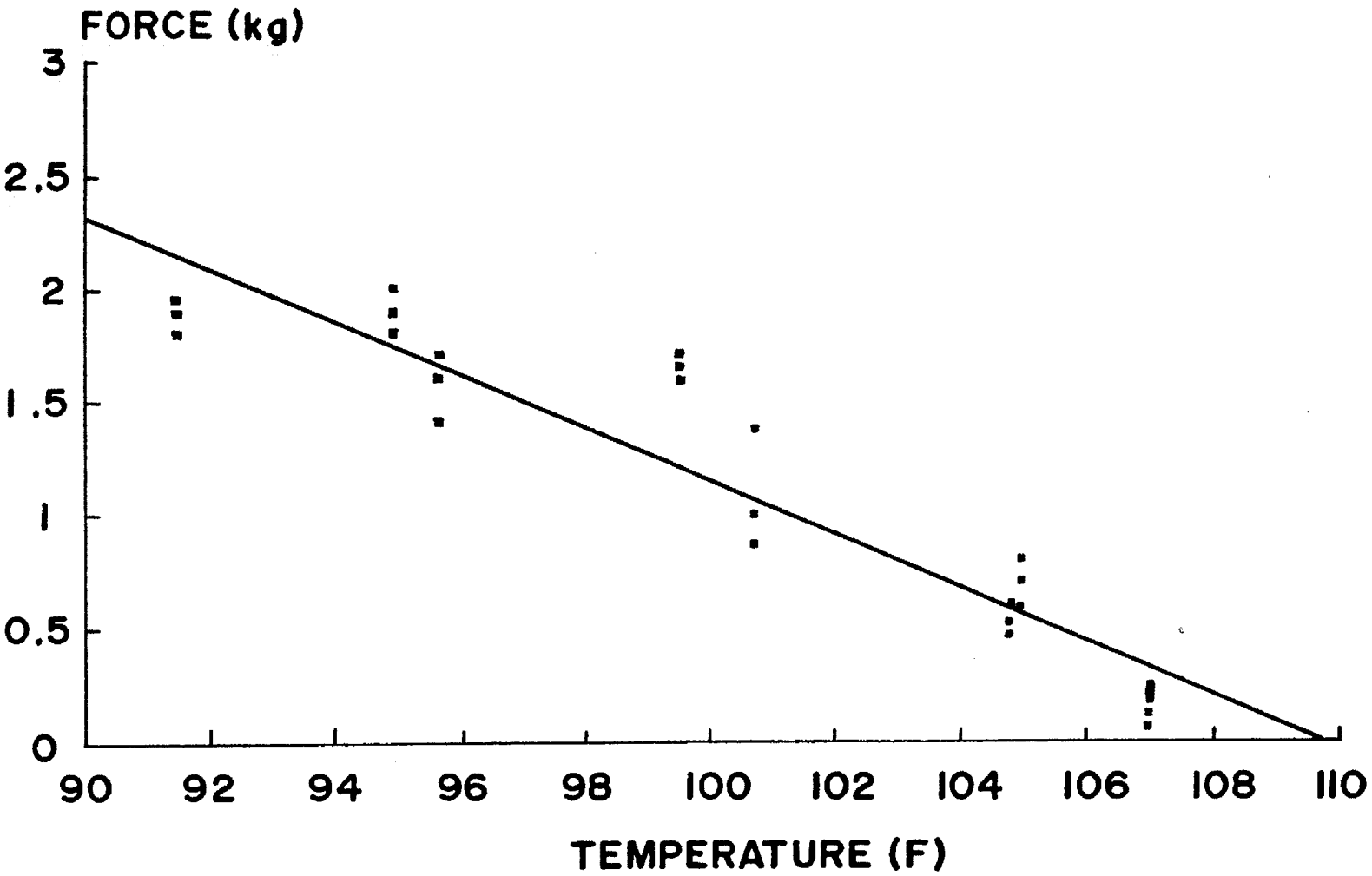
FIG. 1 is a graph of force as a function of temperature (tackiness measurement) for a commercial synthetic soap bar comprising soap and coco fatty acid isethionates. This graph shows that for this bar (which comprises at least 50% soap), tackiness values are tolerable at temperatures both above and below 100° F. coming out of the extruder; however, throughput values are much higher at temperatures above 100° F. (see comparative bar B in example 5).

The present invention relates to detergent bar compositions comprising (1) a first synthetic surfactant which is an anionic surfactant; (2) a mixture of surfactant wherein said mixture comprises a second anionic surfactant which is different from the first and amphoteric surfactant; wherein the composition has a higher throughput when processed at a temperature of less than 100° F. coming out of the soap bar plodder/extruder than when processed at temperature above 100° F. coming out of the plodder. Moreover, the process is achieved while maintaining tackiness value of under 5, preferably under 4, more preferably to 1 to 4, most preferably 2 to 4. Preferably the composition has a soap content of less than 5% by weight, and more preferably less than 3% by weight.

Compositions

Typical mild detergent bar compositions will comprise less than 5% soap and most preferably less than 3% soap.

The term "soap" is used herein in its popular sense, i.e., the alkali metal or alkanol ammonium salts of aliphatic alkane- or alkene monocarboxylic acids. Sodium, potassium, mono-, di- and tri-ethanol ammonium cations, or combinations thereof, are suitable for purposes of this invention. In general, sodium soaps are used in the compositions of this invention, but from about 1% to about 25% of the soap may be potassium soaps. The soaps useful herein are the well known alkali metal salts of natural or synthetic aliphatic (alkanoic or alkenoic) acids having about 12 to 22 carbon atoms, preferably about 12 to about 18 carbon atoms. They may be described as alkali metal carboxylates of acrylic hydrocarbons having about 12 to about 22 carbon atoms.

Soaps having the fatty acid distribution of coconut oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are $C_{16}$ and higher. Preferred soap for use in the compositions of this invention has at least about 85% fatty acids having about 12 to 18 carbon atoms.

Coconut oil employed for the soap may be substituted in whole or in part by other "high-lauric" oils, that is, oils or fats wherein at least 50% of the total fatty acids are composed of lauric or myristic acids and mixtures thereof. These oils are generally exemplified by the tropical nut oils of the coconut oil class. For instance, they include: palm kernel oil, babassu oil, ouricuri oil, tucumoil, cohune nut oil, murumuru oil, jaboty kernel oil, khakan kernel oil, dika nut oil, and ucuhuba butter.

A preferred soap is a mixture of about 15% to about 20% coconut oil and about 80% to about 85% tallow. These mixtures contain about 95% fatty acids having about 12 to about 18 carbon atoms. The soap may be prepared from coconut oil, in which case the fatty acid content is about 85% of $C_{12}$–$C_{18}$ chain length.

The soaps may contain unsaturation in accordance with commercially acceptable standards. Excessive unsaturation is normally avoided.

Soaps may be made by the classic kettle boiling process or modern continuous soap manufacturing processes wherein natural fats and oils such as tallow or coconut oil or their equivalents are saponified with an alkali metal hydroxide using procedures well known to those skilled in the art. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate.

The first anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The first anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$RO(CH_2CH_2O)_nSO_3M$ wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Sulfosuccinates may be monoalkyl sulfosuccinates having the formula:

$R^4O_2CCH_2CH(SO_3M)CO_2M$; and amide-MEA sulfosuccinates of the formula:

$R^4CONHCH_2CH_2O_2CCH_2CH(SO_3M)CO_2M$ wherein $R^4$ ranges from $C_8$–$C_{22}$ alkyl and M is a solubilizing cation.

Sarcosinates are generally indicated by the formula:

$R'CON(CH_3)CH_2CO_2M$, wherein R' ranges from $C_8$–$C_{20}$ alkyl and M is a solubilizing cation.

Taurates are generally identified by the formula:

$R^2CONR^3CH_2CH_2SO_3M$ wherein $R^2$ ranges from $C_8$–$C_{20}$ alkyl, $R^3$ ranges from $C_1$–$C_4$ alkyl and M is a solubilizing cation.

Particularly preferred are the $C_6$ to $C_{18}$ acyl isethionates. These esters are prepared by reaction between alkali metal isethionate with mixed aliphatic fatty acids having from 6 to 18 carbon atoms and an iodine value of less than 20. Unlike the acyl isethionates of U.S. Pat. No. 4,954,282 to Rys et al. (known as "stearic" DEFI), the isethionate mixture must be such that the percentage of $C_{16}$ to $C_{18}$ chain length isethionate in the mixture is less than 75% of the mixture, preferably less than 70%, more preferably less than 60% and, most preferably, less than 50% of the mixture. While stearic DEFI may be milder, it is a very poor lather generator and may be difficult to process.

Acyl isethionates, when present, will generally range from about 10% to about 70% by weight of the total composition. Preferably, this component is present from about 30% to about 60%.

The acyl isethionate may be an alkoxylated isethionate such as is described in Ilardi et al., U.S. application Ser. No. 07/796,748, hereby incorporated by reference, which was filed Nov. 25, 1991, abandoned, and continued-in-part as U.S. application Ser. No. 08/190,628, the latter which was filed Feb. 2, 1994 and issued as U.S. Pat. No. 5,433,894. This compound has the general formula:

$$RC(=O)-O-CH(X)-CH_2-(OCH(Y)-CH_2)_m-SO_3M^+$$

wherein R is an alkyl group having 8 to 18 carbons, m is an integer from 1 to 4, X and Y are hydrogen or an alkyl group having 1 to 4 carbons and $M^+$ is a monovalent cation such as, for example, sodium, potassium or ammonium.

In general the anionic component will comprise from about 10 to 70% of the composition, preferably 30–70%, most preferably 40–60% of the composition.

The second component of the invention is a mixture comprising a second anionic and amphoteric surfactant. The second anionic in the mixture may be any of the anionic surfactants discussed above except that it should be different than the first anionic component. If the anionic is acyl isethionate, it must also be an acyl isethionate mixture such that $C_{16}$ to $C_{18}$ chain length isethionate in the mixture is less than 75%, preferably less than 70%, more preferably less than 60% and, most preferably, less than 50% of the mixture.

Amphoteric detergents which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

$$R^1-C(=O)-NH(CH_2)_m-N^+(R^2)(R^2)(R^3)_n-X-Y$$

where R' is alkyl or alkenyl of 7 to 18 carbon atoms;

$R^2$ and $R^3$ are each independently alkyl, hydroxyalkyl or carboxyalkyl of I to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

Suitable amphoteric detergents within the above general formula include simple betaines of formula:

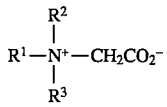

and amido betaines of formula:

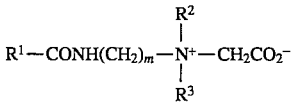

where m is 2 or 3.

In both formulae $R^1$, $R^2$ and $R^3$ are as defined previously. $R^1$ may in particular be a mixture of $C_{12}$ and $C_{14}$ alkyl groups derived from coconut so that at least half, preferably at least three quarters of the groups $R^1$ have 10 to 14 carbon atoms. $R^2$ and $R^3$ are preferably methyl.

A further possibility is that the amphoteric detergent is a sulphobetaine of formula:

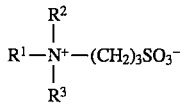

or

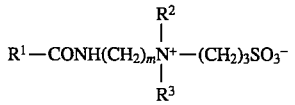

where m is 2 or 3, or variants of these in which $-(CH_2)_3SO_3^-$ is replaced by

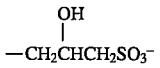

In these formulae $R^1$, $R^2$ and $R^3$ are as discussed previously.

Some nonionic surfactant may also be used in the composition. The nonionics which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Ser. No. 981,737 to Au et al. which is hereby incorporated by reference or it may be one of the sugar amides described in U.S. Pat. No. 5,009,814 to Kelkenberg, hereby incorporated into the subject application by reference.

Other surfactants which may be used are described in U.S. Pat. No. 3,723,325 to Parran Jr. which is also incorporated into the subject application by reference.

In general the second component mixture (i.e., second anionic and amphoteric compound or mixture) is incorporated into the composition at about 1 to about 20% by wt., preferably 1 to 15% by weight of the composition.

Free fatty acids of 8–22 carbon atoms may also be desirably incorporated within the compositions of the present invention. Some of these fatty acids are present to operate as superfattying agents and others as skin feel and creaminess enhancers. Superfatting agents enhance lathering properties and may be selected from fatty acids of carbon atoms numbering 8–18, preferably 10–16, in an amount up to 35% by weight of the composition. Skin feel and creaminess enhancers, the most important of which is stearic acid, are also desirably present in these compositions.

Skin mildness improvers also preferably used in the composition of the invention are salts of isethionate. Effective salts cations may be selected from the group consisting of alkali metal, alkaline earth metal, ammonium, alkyl ammonium and mono-, di- or tri-alkanolammonium ions. Specifically preferred cations include sodium, potassium, lithium, calcium, magnesium, ammonium, triethylammonium, monoethanolammonium, diethanolammonium or triethanolammonium ions.

Particularly preferred as a mildness improver is simple, unsubstituted sodium isethionate of the general formula wherein R is hydrogen.

The skin mildness improver will be present from about 0.5% to about 50%. Preferably, the mildness improver is present from about 1% to about 25%, more preferably from about 2% to about 15%, optimally from 3% to 10%, by weight of the total composition.

Other performance chemicals and adjuncts may be needed with these compositions. The amount of these chemicals and adjuncts may range from about 1% to about 40% by weight of the total composition. For instance, from 2 to 10% of a suds-boosting detergent salt may be incorporated. Illustrative of this type additive are salts selected from the group consisting of alkali metal and organic amine higher aliphatic fatty alcohol sulfates, alkyl aryl sulfonates, and the higher aliphatic fatty acid taurinates.

Adjunct materials including germicides, perfumes, colorants, pigments such as titanium dioxide and water may also be present.

Processing

Initially, the components of the bar formulation should be intimately mixed. This can be accomplished by mixing the components in an aqueous slurry, typically using 6 to 15% water (94–85% solids) from 100° C. to 200° C.

The slurry can be drum-dried to a moisture content up to 9% in the dry mix. Alternatively, the components can be mixed dry, preferably in a mechanical mixer such as a Werner-Pfleiderer or Day mixer. At 85° C. (185° F.), a few hours of mixing may be necessary to dry the mixture to the desired moisture, while at 115° C. (240° F.), a smooth blend will be obtained in approximately one half hour. The time can be reduced by further increasing the temperature, which will of course be kept below a temperature at which any of the components would be degraded. All of the components can be added together, or it may be desirable to mix the lathering detergent with an amount of water first and then incorporate the other ingredients.

After the components have been mixed, the composition is cooled and solidified, typically using a chilled flaker, to form small chips. The chips are mixed with perfume and color is added. The perfumed product is transferred to the packing floor and extruded in the form of billets.

It is at this point where the novelty of the invention is defined. In prior art compositions comprising synthetic ingredients (e.g., acyl isethionate), it has not been possible to prepare bars wherein the throughput is higher when measured at temperature of below 100° F. coming out of the plodder bar than when measured at temperatures above 100° F. Moreover, the tackiness value must be within tolerable limits (i.e., the throughput must be at an economically viable rate).

Specifically, in prior art compositions, at lower temperatures (i.e., below 100° F.) the formulation either tends to be hard and difficult to extrude at economically viable rates or alternatively, the rates are simply better at temperatures above 100° F.

In addition, some formulations are stickier/tackier and yield a tackiness measurement high enough at temperatures below 100° F. (i.e., above 5 kg/729 $mm^2$).

A typical commercial packing line plodder is a Mazzoni B300/3500 which is capable of plodding a pure soap bar composition at a rate of 3500 kgs/hr. (i.e., about 7500–8000 lbs/hr).

The following examples are meant to be illustrative only and are not intended to limit the invention in any way.

EXAMPLES

METHODOLOGY—MEASURING TACKINESS

The tackiness of the bars of the invention is measured using a tackiness measurement device as described in greater detail below:

Measurement is accomplished essentially by placing an object of known surface area and impaling this object (using the conical area of the object) into the bar billet.

Specifically, the object is a pointed metal cylinder made of aluminum which penetrates the bar. The object is shaped like a sharpened pencil or a top and comprises both a top cylindrical section and a bottom conical section which conical section initially impales the bar.

In the examples of this invention, the overall length of the pointed cylinder was 64 mm with the length of the cylindrical section being 51 mm and the length of the conical section being 13 mm. Diameter was 25.5 mm. Surface area of the cone was 729.4 $mm^2$ or 7.294 $cm^2$. Since the entire conical section is used to impale the soap billet each time, the surface area is kept constant and the force measurements can be compared directly. Typical data are expressed in the following terms.

| Material | Temperature | Tackiness Force (kg) | Tackiness Force/Unit Area (kg/cm) |
|---|---|---|---|
| Soap #1 | 100.0° F. | 3.9 | 0.535 |
| Soap #1 | 98.8° F. | 3.6 | 0.494 |

Method of Use

The cylinder is placed through a centering bushing located on a bridge and is positioned over the soap billet which is held in a vise attachment. The pointed cylinder is then pushed into the soap billet in such a manner that the top of the cylinder is flush with the top of the centering bushing. This ensures that the cylinder is impaled the same distance each time and therefore the surface area is constant. There is a threaded hook inserted into the top of the cylinder. This hook is positioned over an inverted hook protruding from a dynamometer (force measuring device). The dynamometer is attached to a movable arm that is driven by a low RPM motor. Once the cylinder is impaled and the hooks are correctly positioned, the motor is started and the arm begins to move upward away from the soap billet. The moving arm pulls the dynamometer which in turn pulls the cylinder. The dynamometer measures the maximum force applied exactly at the time the cylinder breaks apart from the soap billet. The test is performed three times at each temperature using three different pointed cylinders. The tackiness data is then plotted versus temperature for each bar formulation.

Examples 1–4

Figure 2:
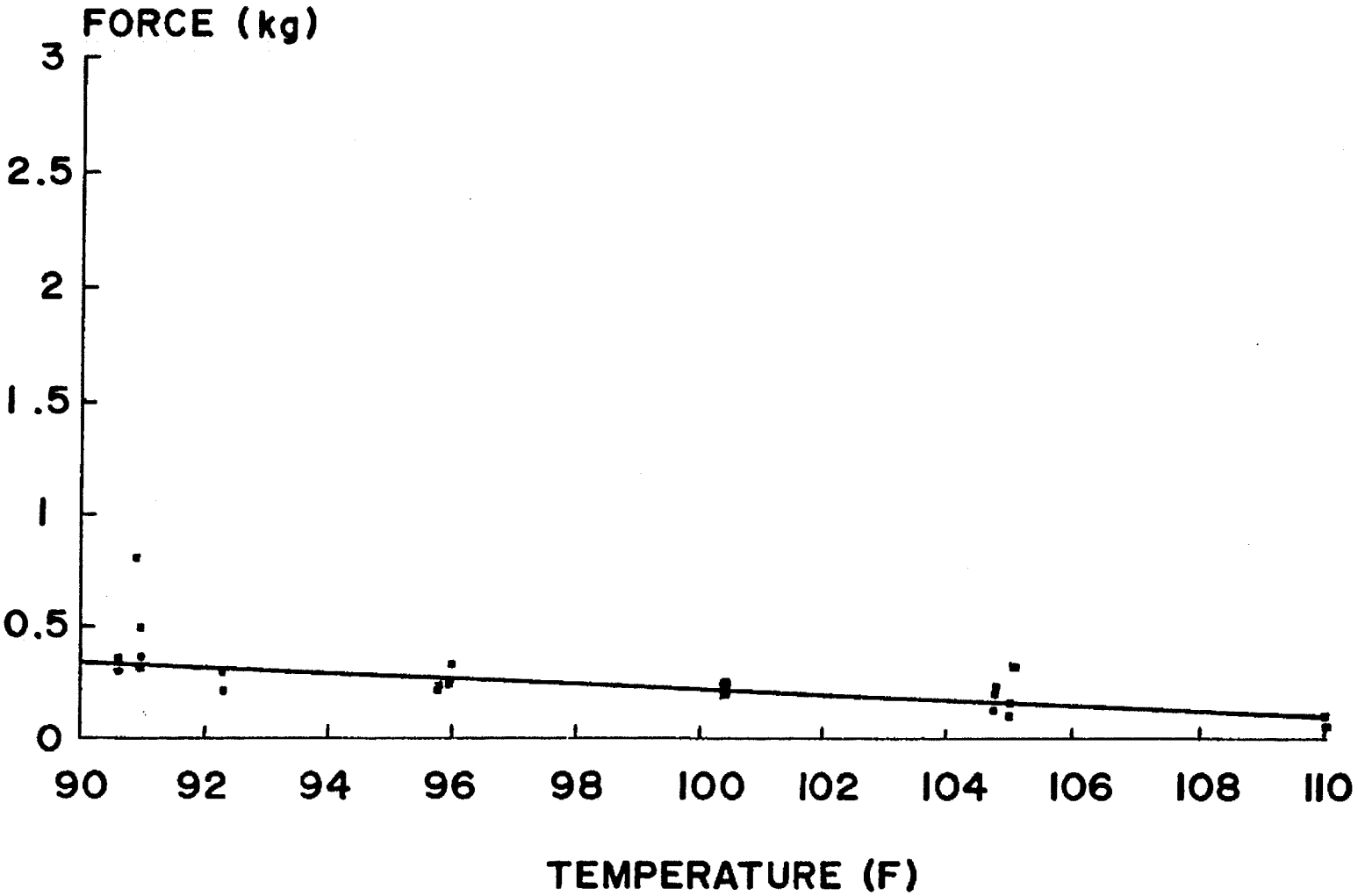
FIG. 2 is a graph of force as a function of temperature for a commercially available pure soap bar. This graph shows that, for this pure soap bar, tackiness is again not a problem. Throughput rates are again, however, much higher at temperatures above 100° F. (see comparative bar C in Example 5).
Figure 3:
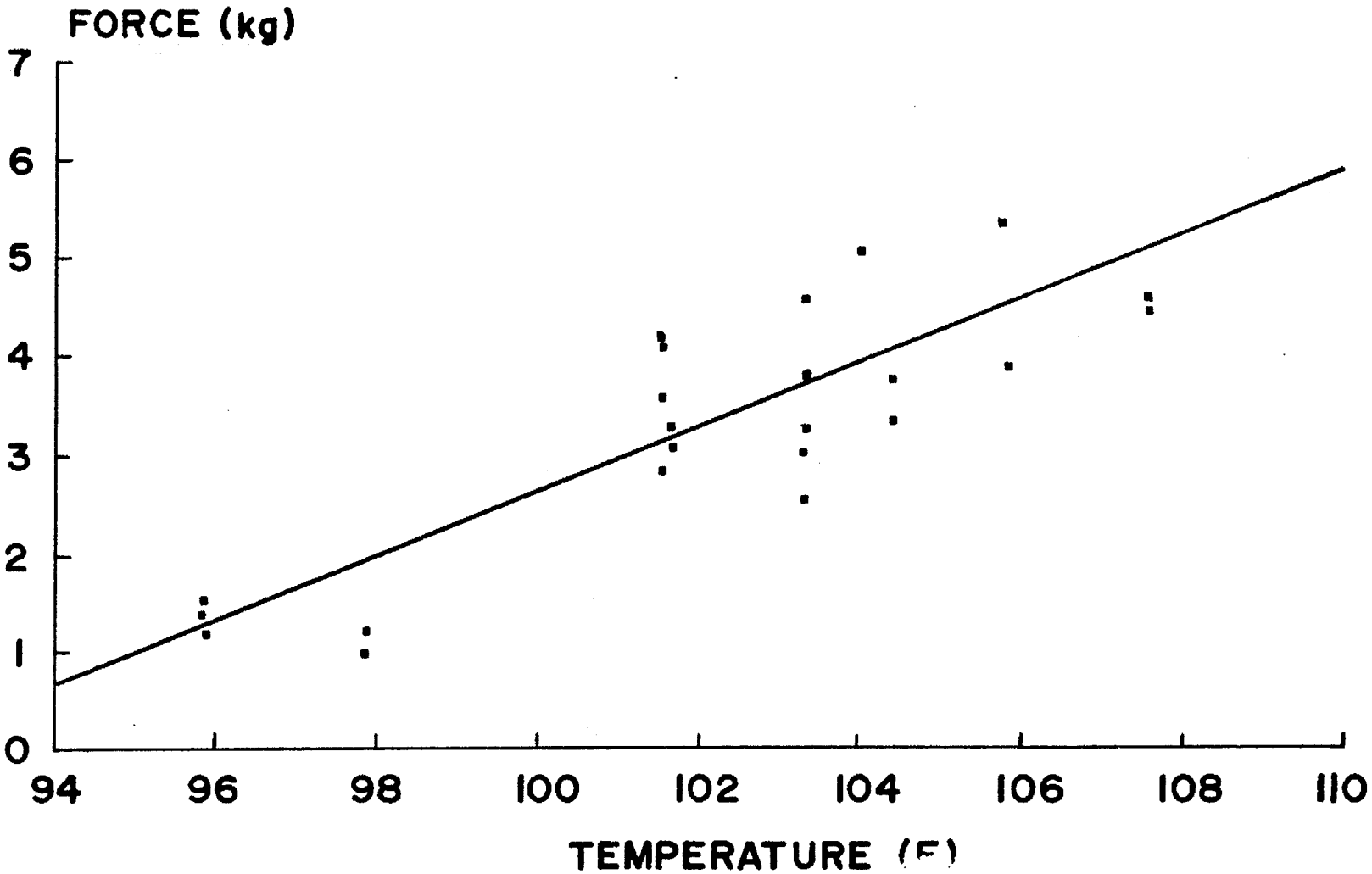
FIG. 3 is a graph of force as a function of temperature for another commercially available bar comprising primarily acyl isethionate. This graph shows that most of these bars, whose primary component is acyl isethionate, process at a temperature coming out of the plodder of above 100° F. within tolerable tackiness levels. While the bars can be plodded at temperatures below 100° F. at good tackiness levels, optimal throughput is achieved at temperatures above 100° F. (see comparative bar A in Example 5).
Figure 4:
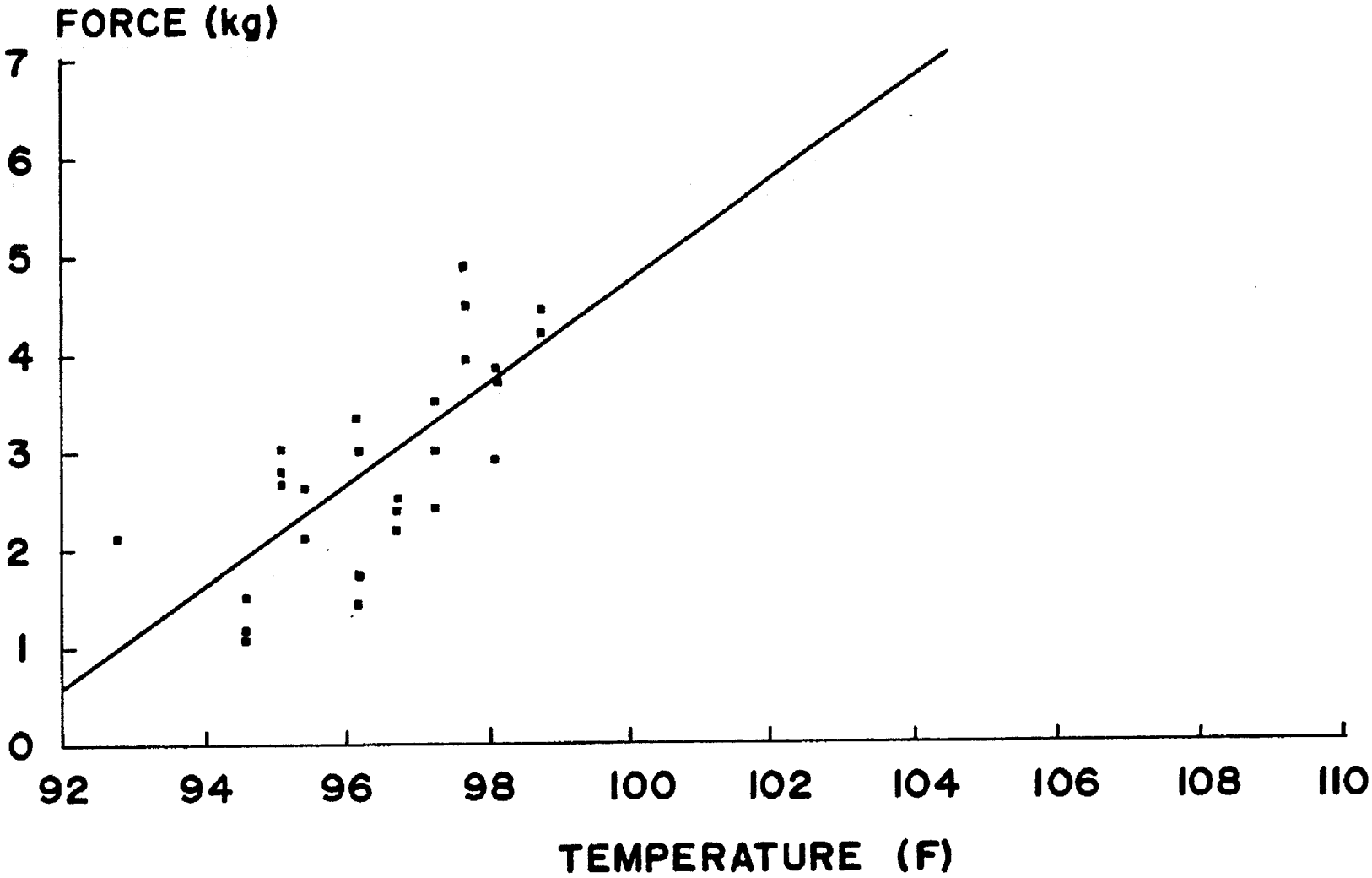
FIG. 4 is a graph of a composition of the invention (comprising soap, acyl isethionate, sulfosuccinate and betaine) as a function of temperature (see Examples 1–4). This bar has higher throughput when processed at temperatures below 100° F. out of the plodder than it does when processed at temperatures above 100° F. (see Experimental Formula A of Example 5). Moreover, it is processed within tolerable tackiness limits; i.e., under 5, preferably under 4, most preferably from 1 to 4.
Figure 5:
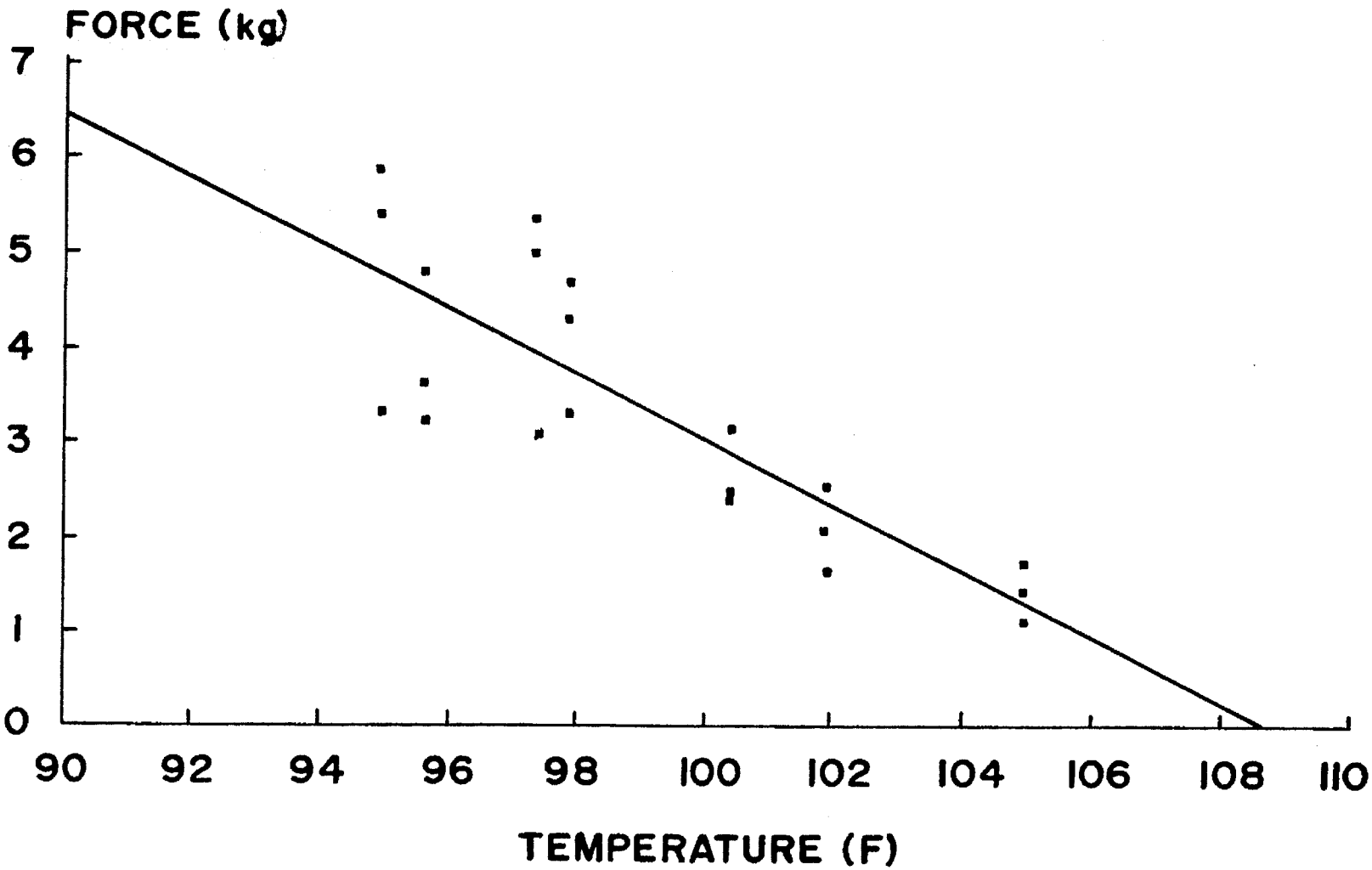
FIG. 5 is a graph of another composition of the invention (comprising soap and sulfosuccinate, but no betaine) as a function of temperature. This Experimental Formula B is identical to the Experimental Formula A of Example 5 except that it contains no betaine. This bar has higher throughput when processed at temperatures below 100° F. out of the plodder than it does when processed at temperatures above 100° F. (see Example 6). Further, it is processable within tolerable tackiness limits.
Figure 6:
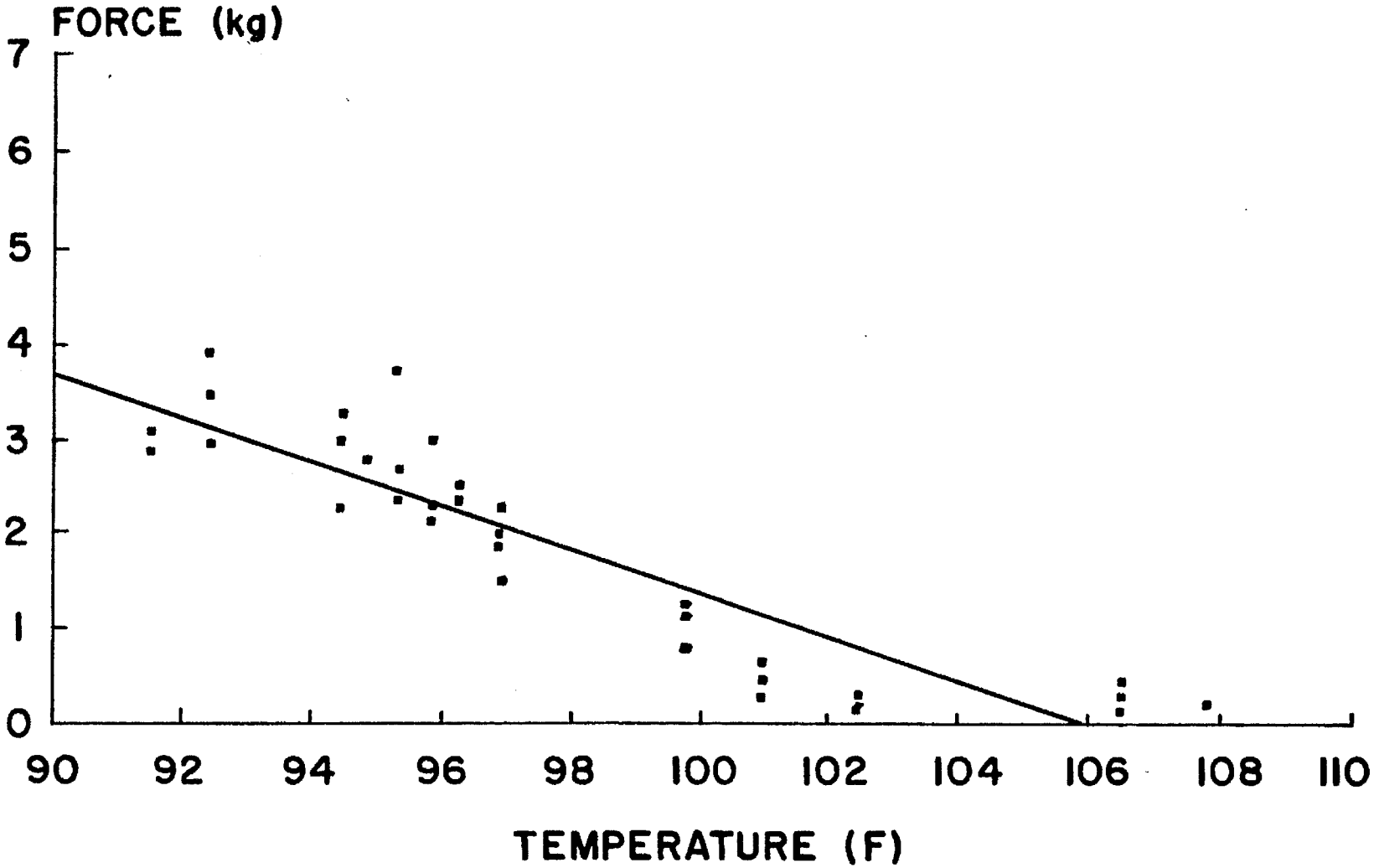
FIG. 6 is a graph of another composition of the invention (comprising soap and betaine, but no sulfosuccinate) as a function of temperature. This Experimental Formula E is identical to Experimental Formula A of Example 5 except that it contains no sulfosuccinate. This bar has higher throughput when processed at temperatures below 100° F. out of the plodder than it does when processed at temperatures above 100° F. (see Example 6). Further it is processed within tolerable tackiness limits.

Examples 1–4 refer to FIGS. 1–4 accompanying the specification. Specifically, Examples 1–3 represent bars which have been tested for tackiness by measuring force (using tackiness measuring device) as a function of temperature. While the bars can be processed at temperatures below 100° F. coming out of the plodder, as seen in Example 5, the throughput rate is higher at temperatures above 100° F.

By contrast, the low soap comprising compositions of the invention not only have tolerable tackiness values when measured at temperatures below 100° F., but also achieve optimal throughput values at these temperatures.

A typical composition of the invention is set forth below.

Example 5

In order to show that the throughput rate of the compositions of the invention is higher when measured at temperatures below 100° F. compared to the throughput rate at temperatures at above 100° F., applicants measured the bars of Figures and Examples 1–4.

The chart below shows the effect of temperature on throughput. All product was extruded using a Mazzoni M-150 refiner/plodder. The screw diameter was 150 mm while the plodder die plate opening was 49.5 mm by 27.5 mm. The refiner screw was run at 15.0 RPM while the plodder screw was run at 8.0 RPM throughout the experiment. The results are shown below:

| | Throughput Rate (lb/hr) | |
|---|---|---|
| | 95° F. | 105° F. |
| Comparative A | 390 | 492 |
| Experimental Formula A | 372 | 54 |
| Comparative B | 312 | 432 |
| Comparative C | 408 | 642 |

| Experimental Formula A | |
|---|---|
| Component | % by wt. |
| Fatty acid isethionate | about 50.00 |
| Free fatty acid | about 25.00 |
| Free isethionate | about 5.5 |
| Sulfosuccinate* | about 6.0 |
| Betaine** | about 2.0 |
| Preservative, dyes, water and other minors | remainder |

*Cocoamido sulfosuccinate
**Cocoamidopropyl betaine

The data clearly shows that for three current commercial formulations (Comparatives A, B & C) the throughput increases with temperature (i.e., over 100° F.), while, by contrast, the throughput decreases over 100° F. for the experimental formulation. While not wishing to be bound by theory it is believed this phenomenon occurs (for the composition of the invention) because the formulation becomes soft and churns in the refiner/plodder at temperatures above 100° F.

Moreover, tackiness values of the composition are sufficiently tolerable that economically viable throughput rates (i.e., of at least 2500 pounds/hour when measured on a commercial packing line) are achievable.

Composition of Comparative A, B & C are set forth below:

| | |
|---|---|
| Comparative A | |
| Coco Fatty Acid Isethionate | about 50% |
| Fatty Acids | about 25% |
| Sodium Isethionate | about 5% |
| Soap | about 11% |
| Other ingredients (perfume, water etc.) | about 9% |
| Comparative B | |
| Soap | about 50% |
| Coco Fatty Acid Isethionate | about 20% |
| Sodium isethionate | about 6% |
| Fatty acids | about 9% |
| Other ingredients (perfume, water etc.) | about 15% |
| Comparative C | |
| Soap | about 85% |
| Other ingredients (perfume, water etc.) | about 15% |

Example 6

Applicants also tested Experimental Formula A without sulfosuccinate (defined as Experimental Formula B) and without betaine (defined as Experimental Formula C).

The formulations were again processed using a Mazzoni M-150 refiner/plodder in the pilot plant and throughput rates were measured. The refiner screw was run at 15.0 RPM while the plodder screw was run at 8.0 RPM. Results were set forth below.

| | Throughput Rate (lbs/hr) | |
|---|---|---|
| | 95° F. | 105° F. |
| Experimental Formula B: (Experimental Formula A without sulfosuccinate) | 481 | 366 |
| Experimental Formula C: (Experimental Formula A without betaine) | 375 | 180 |

I claim:

1. A process for preparing a detergent bar comprising the step of extruding a detergent bar composition through a plodder at a temperature below 100° F., said composition consisting essentially of (a) about 10% to about 70% by weight of a first synthetic surfactant which is an anionic surfactant;

(b) 1 to 20% by weight of a mixture of surfactants wherein said mixture comprises a second anionic surfactant which is different from the first and amphoteric surfactant; wherein if either anionic surfactant is $C_6$ to $C_{18}$ acyl isethionate, the percentage of $C_{16}$ to $C_{18}$ chain length isethionate in said mixture is less than about 50% of the mixture; and (c) the balance of at least one component selected from the group consisting of up to 35% by weight $C_8$ to $C_{22}$ free fatty acids, 0.5% to 50% by weight skin mildness improvers and 1% to 40% chemicals and adjuncts selected from the group consisting of suds-boosting detergent salts, germicides, perfumes, colorants, pigments and water;

wherein said composition is essentially free of soap; and wherein the throughput rate of a bar made from processing said composition through a plodder is higher at a temperature below 100° F. than it is above 100° F., said temperature referring to the temperature reading at just after said bar is extruded through said plodder.

2. A process according to claim 1, wherein the first anionic surfactant is a $C_8$ $C_{18}$ acyl isethionate mixture, wherein the percentage of $C_{16}$ to $C_{18}$ chain length isethionate in said mixture is less than 50% of the mixture.

3. A process according to claim 1, wherein component (b) is a mixture of sulfosuccinate as the anionic compound and a betaine compound as the amphoteric.

4. A process according to claim 1, wherein tackiness of the composition is under 5.

5. A process according to claim 4, wherein tackiness of the composition ranges from 1 to 4.

6. A process for preparing a detergent bar comprising the step of extruding a detergent bar composition through a plodder at a temperature below 100° F., said composition consisting essentially of (a) about 10% to about 70% by weight $C_8$ to $C_{18}$ acyl isethionate mixture, wherein the percentage of $C_{16}$ to $C_{18}$ chain length isethionate in said mixture is less than about 50% of the mixture;

(b) 1 to 20% by weight of a mixture of betaine and sulfosuccinate; (c) the balance of at least one component selected from the group consisting of up to 35% by weight $C_8$ to $C_{22}$ free fatty acids, 0.5% to 50% by weight skin mildness improvers and 1% to 40% chemicals and adjuncts selected from the group consisting of suds-boosting detergent salts, germicides, perfumes, colorants, pigments and water; wherein said composition is essentially free of soap; and wherein the throughput rate of a bar made from processing said composition through a plodder is higher at a temperature below 100° F. than it is above 100° F., said temperature referring to the temperature reading at just after said bar is extruded through said plodder.

* * * * *